US012501965B2

(12) United States Patent
De Luca et al.

(10) Patent No.: US 12,501,965 B2
(45) Date of Patent: Dec. 23, 2025

(54) WATER RESISTANT FOOTWEAR AND MANUFACTURING METHOD

(71) Applicant: BASE PROTECTION S.R.L., Barletta (IT)

(72) Inventors: Cataldo De Luca, Trani (IT); Nicola Pedone, Bisceglie (IT); Raffaella Amoruso, Bari (IT)

( * ) Notice: Subject to any disclaimer, the term of this patent is extended or adjusted under 35 U.S.C. 154(b) by 0 days.

(21) Appl. No.: 18/272,303

(22) PCT Filed: Jan. 27, 2022

(86) PCT No.: PCT/IB2022/050730
§ 371 (c)(1),
(2) Date: Jul. 13, 2023

(87) PCT Pub. No.: WO2022/162586
PCT Pub. Date: Aug. 4, 2022

(65) Prior Publication Data

US 2024/0065371 A1 Feb. 29, 2024

(30) Foreign Application Priority Data

Jan. 29, 2021 (IT) ..... 102021000001952

(51) Int. Cl.
*A43B 7/12* (2006.01)
*A43B 17/04* (2006.01)
(Continued)

(52) U.S. Cl.
CPC ..... *A43B 7/125* (2013.01); *A43B 7/12* (2013.01); *A43B 17/04* (2013.01); *A43B 23/0255* (2013.01); *A43B 23/26* (2013.01)

(58) Field of Classification Search
CPC ..... A43B 7/12; A43B 7/125; A43B 23/0255; A43B 23/022; A43B 23/07; A43B 23/26; A43B 23/045; A43B 23/047
See application file for complete search history.

(56) References Cited

U.S. PATENT DOCUMENTS 3,007,262 A * 11/1961 Richards ..... A43C 11/006 36/51
3,264,761 A * 8/1966 Johnson ..... A43B 23/0235 427/373

(Continued)

FOREIGN PATENT DOCUMENTS

EP 2375928 A2 10/2011
GB 1144564 A 3/1969
WO WO-2020089553 A1 * 5/2020 ..... A43B 13/10

OTHER PUBLICATIONS

Translation of WO 2010/066656, Pavelescu, Liviu-Mihai, Jun. 17, 2010, translated via Espacenet (Year: 2010).*

(Continued)

*Primary Examiner* — Heather Mangine
(74) *Attorney, Agent, or Firm* — Egbert, McDaniel & Swartz

(57) ABSTRACT

A water resistant footwear having an upper made of a water vapor transpiring material resistant to water with a first extreme flap and at least a portion having a first thickness and provided with a second extreme flap. The first flap and the second flap have relative second thicknesses lower than the first thickness of the portion and are superimposed on each other with the interposition of a thermo-double-sided adhesive layer which can be activated by raising the temperature. The first flap and the second flap superimposed are fixed to each other by thermo-sealing. Furthermore, the footwear has an insole fixed to an edge of the upper and a waterproof sole obtained by direct injection molding on the upper and arranged so as to cover one face of the insole and seal it.

11 Claims, 4 Drawing Sheets

(51) Int. Cl.
*A43B 23/02* (2006.01)
*A43B 23/26* (2006.01)

(56) References Cited

U.S. PATENT DOCUMENTS 3,481,054 A * 12/1969 Glassman ..... A43B 23/07 36/55
3,972,136 A * 8/1976 Epstein ..... A43B 3/10 36/101
4,255,875 A * 3/1981 Gilkerson ..... A43B 23/07 36/77 R
4,308,671 A * 1/1982 Bretschneider ..... A43B 1/0045 36/11
4,736,531 A * 4/1988 Richard ..... A43B 23/087 36/31
5,664,343 A * 9/1997 Byrne ..... A43B 23/07 36/12
6,065,227 A * 5/2000 Chen ..... A43B 23/06 12/142 E
6,148,544 A * 11/2000 Keen ..... A43B 23/06 36/129
6,260,288 B1 * 7/2001 Barthelemy ..... A43B 19/00 36/3 R
6,874,256 B2 * 4/2005 Delgatty ..... A43D 999/00 36/100
7,392,603 B1 * 7/2008 Shepherd ..... A43B 23/26 36/114
11,297,902 B2 * 4/2022 Lee ..... A43B 23/0215
2003/0061737 A1 * 4/2003 Zhu ..... A43B 23/07 36/55
2004/0083624 A1 * 5/2004 Chen ..... A43B 23/06 36/55
2004/0134101 A1 * 7/2004 Chen ..... A43B 7/12 36/4
2004/0205982 A1 * 10/2004 Challe ..... A43B 23/07 36/55
2005/0034333 A1 * 2/2005 Chen ..... A43B 23/07 36/117.1
2005/0115112 A1 * 6/2005 Bonfanti ..... A43B 23/047 36/97
2006/0096123 A1 * 5/2006 Grandini ..... A43B 7/08 36/3 B
2007/0175064 A1 * 8/2007 Culton ..... A43C 11/1493 36/7.1 R
2007/0199210 A1 * 8/2007 Vattes ..... A43B 7/085 36/45
2007/0245595 A1 * 10/2007 Chen ..... A43B 9/02 36/47
2008/0216354 A1 * 9/2008 Morlacchi ..... A43B 9/02 36/98
2009/0019727 A1 * 1/2009 Fenzi ..... B32B 27/12 36/43
2009/0094865 A1 * 4/2009 Chen ..... A43B 15/00 36/25 R
2010/0115792 A1 * 5/2010 Muller ..... B29D 35/146 12/146 B
2010/0319221 A1 * 12/2010 McClaskie ..... A43B 9/10 36/43
2011/0023215 A1 * 2/2011 Obradovic ..... A43B 13/223 36/25 R
2012/0090103 A1 * 4/2012 Hernandez ..... A43B 23/0215 12/142 R
2012/0180338 A1 * 7/2012 Lin ..... A43B 9/02 36/56
2012/0180340 A1 * 7/2012 Crowley ..... A43B 1/0027 36/103
2013/0047471 A1 * 2/2013 Liang ..... A43B 13/12 428/156
2013/0111784 A1 * 5/2013 Kann ..... A43B 5/18 36/72 R
2013/0232818 A1 * 9/2013 Wiener ..... A43B 7/125 36/102
2013/0340289 A1 * 12/2013 Thevenoud ..... A43B 7/085 36/103
2015/0027001 A1 * 1/2015 VanDernoot ..... A43B 7/125 36/83
2015/0305448 A1 * 10/2015 Cavaliere ..... B29C 66/54 12/145
2015/0374064 A1 * 12/2015 Pierobon ..... A43B 7/125 36/3 R
2016/0168774 A1 * 6/2016 Breithaupt ..... B29D 35/00 442/381
2016/0353829 A1 * 12/2016 Chen ..... A43B 23/047
2017/0099909 A1 * 4/2017 Lee ..... A43B 23/07
2017/0258182 A1 * 9/2017 Takahashi ..... A43B 7/125
2018/0199670 A1 * 7/2018 Craven ..... A43C 11/24
2018/0317592 A1 * 11/2018 Rudolf ..... A43B 13/125
2018/0317593 A1 * 11/2018 Dealey ..... D04B 1/24
2019/0059503 A1 * 2/2019 Franklin ..... A43B 1/0072
2020/0029647 A1 * 1/2020 Unnewehr ..... D04B 1/26
2020/0288815 A1 * 9/2020 Wang ..... A43B 23/025
2020/0297069 A1 * 9/2020 Bell ..... A43B 13/125
2020/0297077 A1 * 9/2020 Craven ..... A43C 11/20
2021/0137174 A1 * 5/2021 Jenkins ..... A41B 11/002
2021/0195998 A1 * 7/2021 Notrica ..... A43B 23/027
2021/0378354 A1 * 12/2021 Wang Chang ..... A43B 23/0255
2022/0125162 A1 * 4/2022 Dulude ..... A43B 19/00
2022/0192318 A1 * 6/2022 Chang ..... A43B 7/20
2023/0008469 A1 * 1/2023 Wang ..... A43B 7/125
2023/0091843 A1 * 3/2023 Jensen ..... A43B 23/0255 36/25 R
2023/0225458 A1 * 7/2023 Shi ..... A43B 23/0255 36/45
2024/0065371 A1 * 2/2024 De Luca ..... A43B 7/125
2024/0164482 A1 * 5/2024 Liu ..... A43B 23/0255

OTHER PUBLICATIONS

International Search Report for corresponding PCT/IB2022/050730 dated May 23, 2022.
Written Opinion of the International Searching Authority for corresponding PCT/IB2022/050730 dated May 23, 2022.

* cited by examiner

WATER RESISTANT FOOTWEAR AND MANUFACTURING METHOD

TECHNICAL FIELD

The present invention relates to water resistant footwear such as, preferably but not limited to footwear used in the agri-food and catering sectors.

STATE OF THE ART

As known to those working in the sector, the HACCP system (acronym from English of Hazard Analysis and Critical Control Points) is a system of risk analysis and control of critical points to ensure the prevention of risks and safety in the preparation processes of food and beverages.

In the catering and food industry, the HACCP system regulates the behavior of operators in the processing and cleaning or sanitizing phase of food. This system involves risk assessment, evaluation of possible alternatives for risk management and the adoption of measures and of Individual Protective Device (IPD) in order to prevent or avoid such risks.

The European legislation sets precisely the specifications of professional clothing, and therefore also of footwear, in the agri-food and catering sectors.

With reference to professional footwear, it is required that the upper, whatever the material that constitutes it, must meet the technical specifications relating, among other things, to the following parameters: permeability to water vapor, coefficient of water vapor, water penetration and absorption. The integral footwear must also meet water resistance requirements.

Furthermore, in relation to hygienic requirements, it is required that the professional clothing items be such as to reduce the presence and extent of forms that facilitate the entrapment or retention of impurities.

Professional footwear is known in which the upper is obtained by sewing several portions or more flaps of a shaped piece made of leather or a synthetic material (such as microfiber). Furthermore, according to this type of professional footwear, the waterproofing characteristics are obtained by using a waterproof membrane (typically, made either of PTFE or polyester) which internally covers the upper or is interposed between the upper and the inner lining.

Document WO2010/066656 describes a method of manufacturing a shoe in which a functional waterproof element interposed between the upper and lining is provided.

Document GB1144564 discloses a method of manufacturing footwear in which portions of the upper are bonded together by the application of heat and pressure.

SUMMARY OF THE INVENTION

The Applicant has noted that the traditional manufacturing techniques of footwear with waterproof characteristics (including professional footwear in the agri-food and catering sectors) are not satisfactory both because of their constructive complexity and in relation to some specifications, such as those concerning cleaning or sanitizing requirements.

The technical problem faced by the present invention is that of proposing a type of footwear of the water resistant type that is an alternative to the traditional ones and the manufacture of which is not complex, while offering satisfactory performances, for example, in relation to their cleaning and sanitization.

According to a first aspect, the above described problem is solved by a footwear as described by claim 1 and by preferred embodiments thereof as defined by the dependent claims.

In accordance with a second aspect, the above problem is solved by a method of manufacturing a footwear.

BRIEF DESCRIPTION OF THE DRAWINGS

The present invention is described in detail below, by way of a non limiting example, with reference to the attached drawings, in which.

DETAILED DESCRIPTION

Figure 1:
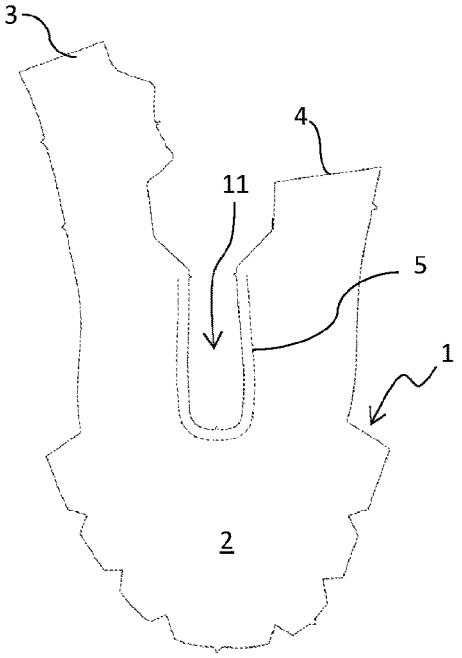
FIG. 1 shows, by way of example, a shaped element from which to obtain an upper.

While the invention is susceptible of various modifications and alternative constructions, some particular embodiments are shown in the drawings and will be described in detail below. In the present description, similar or identical elements or components will be indicated in the figures with the same identification symbol.

An example of a manufacturing method of a footwear 100 (FIGS. 19 and 20) of the water resistant type is described. Preferably, the footwear 100 is of a professional type and is suitable for use in the agri-food and catering sectors, that is, in the HORECA sector (Hotellerie-Restaurant-Café, sometimes also referred to as Hotellerie-Restaurant-Catering). In particular, the footwear 100 is a safety footwear, that is an individual protection device (IPD).

FIG. 1 shows an upper 1 in an intermediate processing step, made in a single piece, that is, which no longer comprises a plurality of distinct portions sewn together, but which is formed by a single suitably shaped element. Furthermore, the upper 1 is made of a water resistant material, i.e. a waterproof material.

Even if the one piece construction is the preferred one because it allows to make a single joint between two flaps of the upper, it is possible to provide, for the construction of the upper, several separate pieces (for example, from two to four pieces) to be joined.

Advantageously, the material of the upper 1 is also breathable, that is, it is permeable to water vapor so as to facilitate the transpiration of the foot.

For example, the outer part of the upper 1 is made of microfiber. Other possible materials for the upper 1 are leather or other types of synthetic materials. In particular, if the upper 1 is used in a safety footwear, its material can be such as to satisfy the technical specifications established by a European Union standard according to tests 1) and 2), indicated below: 1) Penetration and water absorption of the upper (ref. 6.3, EN ISO 20345:2011) after 60 min test according to the test method given in EN ISO 20344:2011 ref. 6.13:

A) water absorption not greater than 30% of the initial weight of the upper;

B) water penetration through the upper not exceeding 0.2 g. 2) Permeability and water vapor coefficient of the upper (ref. 5.4.6, EN ISO 20345:2011) after approximately 8 h according to the test method given in EN ISO 20344:2011 ref. 6.6 and 6.8:

(a) water vapor permeability not less than 0.8 mg/($cm^2$× h);

(b) water vapor coefficient not less than 15 mg/$cm^2$

Water penetration and absorption of test 1) define, according to an example, the resistance to water of the material of which the upper 1 is made. Instead, the permeability and the water vapor coefficient of test 2) define, according to a standard, the perspiration of the upper 1.

Regarding water absorption, it is preferable to use an upper 1 that has an absorption between 0.00% and 20%, i.e., not more than 20%.

Furthermore, the material of the upper 1 is advantageously chosen so as to be mechanically resistant and dimensionally stable if placed in contact with chemically aggressive substances (for example, acidity of food or elements with which the food are treated). The upper 1 is also preferably of the washable type. It should also be noted that in the selection of the material for the upper 1, the above preferred values regarding water absorption are advantageously taken into account, but also the requirements regarding the breathability of the upper itself as defined, for example, by the above standard.

Referring to the particular "one piece" solution, as shown in FIG. 1, the (flat) upper 1 has a (curved, substantially horseshoe-shaped) main portion 2, a first extreme flap 3 and a second extreme flap 4. In this phase, the upper 1 is open, i.e. the two flaps 3 and 4 are not connected to each other. The curved main portion 2 defines an internal opening 11.

In particular, marks 5 are also formed on the upper 1 which can be used as references for subsequent operations. More in detail, the marks 5 made in an area of the main portion 2 (for example, with a pencil or a felt-tip pen) are indicative of the area to which to fix a tongue of the footwear 100.

In a subsequent step, the first flap 3 and the second flap 4 are machined to reduce their thickness with respect to the initial value; this initial value is instead maintained for the main portion 2. In particular, a chamfering and/or skiving of the first flap 3 and of the second flap 4 is carried out in order to reduce their thickness.

Furthermore, this thickness reduction operation is also repeated for a portion of a tongue 6 which will be applied to the upper 1, as indicated below.

Figure 3:
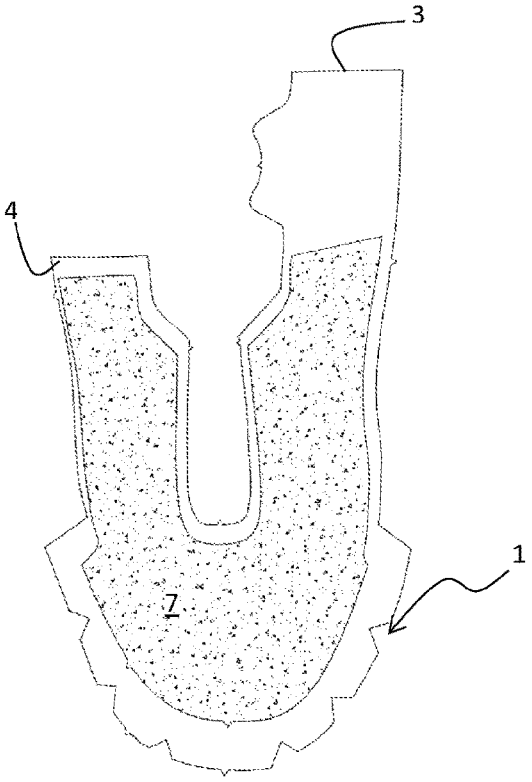
FIG. 3 shows the inside of said upper to which a reinforcement fabric is applied.

According to the example described, a reinforcement fabric 7, provided with an adhesive film that allows a thermo-adhesion, is fixed to an internal face of the upper 1 (FIG. 3), preferably by means of a process which provides for the raising of the temperature and the application of a pressure. The reinforcement fabric 7 covers a large part of the upper 1. For example, the reinforcement fabric 7 is fixed using a hot press machine applying a pressure of 4.5 bar and a temperature of 130° C. for 25 sec. In particular, for the application of the reinforcement fabric 7 the press machine has flat square/rectangular plates. The reinforcement fabric is preferably made of jersey or polyester. The reinforcement fabric 7 is intended to provide rigidity to the upper 1 and does not have waterproof properties.

The method described also comprises a step of fixing the first flap 3 and the second flap 4 so that the upper 1 assumes a closed configuration.

Figure 4:
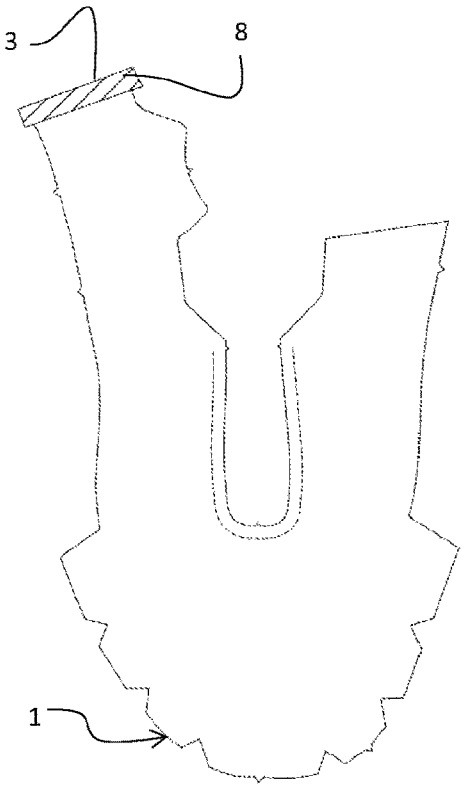
FIG. 4 shows the application of a thermo-double-sided adhesive tape to a flap of the upper.

This step of fixing the flaps 3 and 4 comprises the application of a thermo-double-sided adhesive tape 8 to the first flap 3 (FIG. 4). The thermo-double-sided tape 8 is fixed to the first flap 3 by means of an operation of raising the temperature, in which the thermo-double-sided adhesive layer of the tape 8 facing the first flap 3 is activated, and by means of a pressing operation. For example, to apply the thermo-double-sided tape 8 to the first flap 3, a thermo-adhesion tape machine can be used which operates at the following values: temperature between 125° C. and 135° C. (in particular, equal to 130° C.), pressure of 1.5/2 relative at (where "relative at" stands for relative technical atmosphere). The values indicated are useful to obtain an efficient and uniform adhesion of the thermo-bioadhesive tape 8 to the first flap 3 on the contact surface.

Subsequently, the second flap 4 is placed in contact with the free face of the thermo-double-sided tape 8 and then a thermo-sealing operation is carried out which activates the adhesive of the free side of the thermo-double-sided tape 8, by raising the temperature, with a simultaneous application of pressure. The pressure exerted on the second flap 4 which is superimposed on the first flap 3 facilitates its adhesion to the double-sided adhesive tape 8.

For example, for this operation the same hot press machine mentioned in relation to the application of the reinforcement fabric 7 can be used.

According to a preferred embodiment, the heat-sealing of the second flap 4 to the first flap 3 is performed using the following process parameters:

temperature within the range 130° C.-158° C.; more preferably, within the range 147° C.-152° C.;

pressure within the range of 2.5 bar-5.0 bar; more preferably, within the range of 3.2 bar-4.5 bar;

application duration of the above temperature and pressure values in the range of 20.0 s-39.0 s; more preferably in the range of 24.0 s-32.0 s.

The above values, combined with the use of an upper 1 having a water absorption not exceeding 20%, are particularly suitable to ensure waterproofness of the footwear.

It must be noted that for making the joint of the flaps 3 and 4 the upper 1 is closed in itself in a three-dimensional way, therefore the upper itself is, according to an example, inserted in a long and narrow plate, while an upper plate can be of the flat type.

In this way, the first flap 3 and the second flap 4 are fixed to each other without making seams that pierce the waterproof upper 1. The physical parameters of the process of thermo-adhering the thermo-adhesive 8 to the first flap 3 and thermo-welding the second flap 4 to the first flap 3 are chosen to ensure that the resulting upper 1 is impermeable to water by completely sealing the attachment areas of the two flaps.

Figure 5:
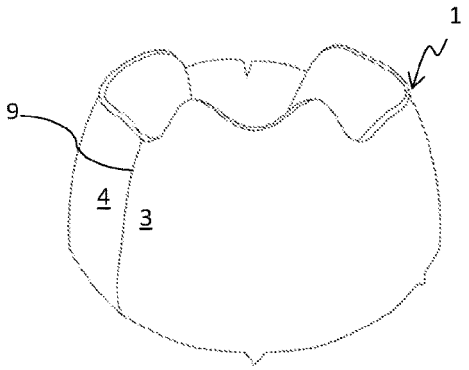
FIG. 5 shows two thermo-sealed flaps of the upper.

Furthermore, it should be noted that as the first flap 3 and the second flap 4 have a reduced thickness with respect to that of the main portion 2 of the upper 1, the area of the upper 1 in which the two flaps 3 and 4 are superimposed (zone 9 in FIG. 5) has no significant discontinuities (such as excess thicknesses that create steps), resulting in a substantially uniform thickness.

In the event that several distinct pieces are used for forming the upper 1 (that is, a material in "one piece" is not used), the joints of these pieces advantageously take place in the same way as described above with reference to the extreme flaps 3 and 4.

Furthermore, preferably, the fixing zone 9 of the two flaps 3 and 4 is in a position which corresponds to a rear side area of the footwear 100. It should be noted that this position of the fixing zone 9 is advantageous in that it presents reduced stresses. Furthermore, the fixing zone 9 preferably has a vertical trend to reduce any possibility of stagnation of impurities or liquids.

Figure 6:
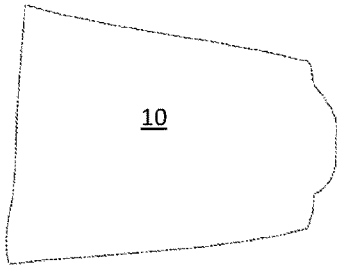
FIG. 6 shows an under-tongue element.

According to the herein described example, the method continues with the fixing to the upper 1 of an under-tongue element 10 (FIG. 6). This under-tongue element 10 is sewn to the upper 1 at or near the marks 5 (shown by way of example in FIG. 1). The under-tongue element 10 is intended to come into contact with the foot of the wearer of the footwear and is preferably made of a soft and elastic material, so as to adapt to the shape of the foot and ensure a certain adjustment of the fit. For example, the sub-tongue element 10 is made of one of the following materials: LYCRA™, elastic mesh, etc.

Figure 7:
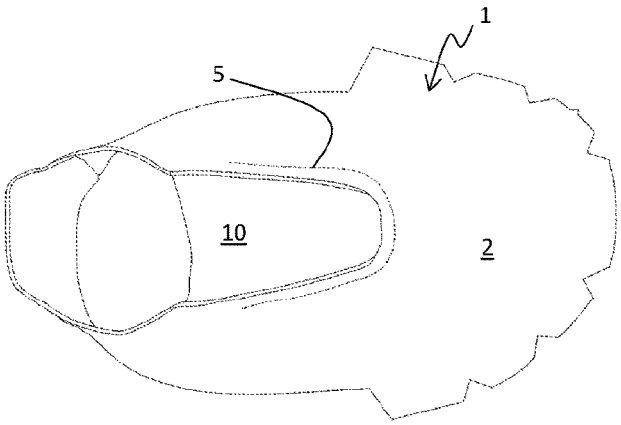
FIG. 7 shows the upper and the under-tongue element sewn to the upper.

As can be seen from FIG. 7, the under-tongue element 10 partially closes the opening 11 (FIG. 1) identified by the curved portion of the upper 1.

According to the example described, the manufacturing method proceeds with phases of application of linings and buttresses.

Figure 8:
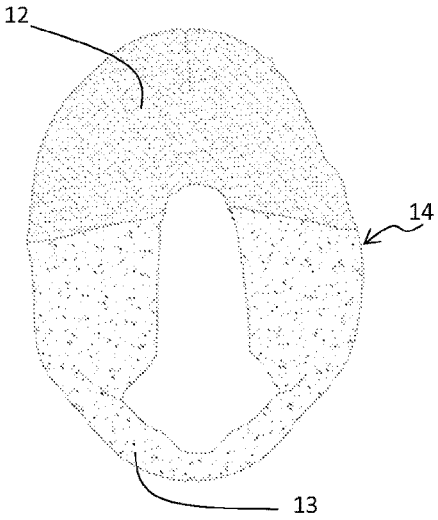
FIG. 8 shows a step of sewing a front lining to a rear lining in order to obtain a corresponding complete lining.

In particular, a front lining portion 12 is sewn to a rear lining portion 13 so as to form a complete lining 14, as illustrated in FIG. 8.

Figure 9:
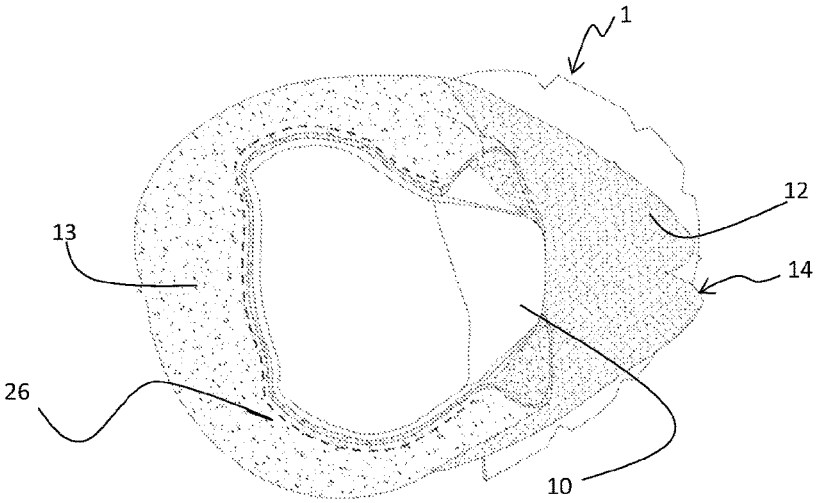
FIG. 9 refers to the application of the lining to the upper.

The lining 14 obtained as indicated above is then sewn to the upper 1; FIG. 9 shows a top seam 26.

The lining 14 is realizable, for example, in one of the following materials: polyester, polyamide, recycled polyester.

Note that the lining 14 is directly facing the upper 1 or between the lining 14 and the upper 1 is interposed only the reinforcement fabric 7 (if provided). Note that, advantageously, there is no waterproof membrane associated with the upper 1.

Figure 10:
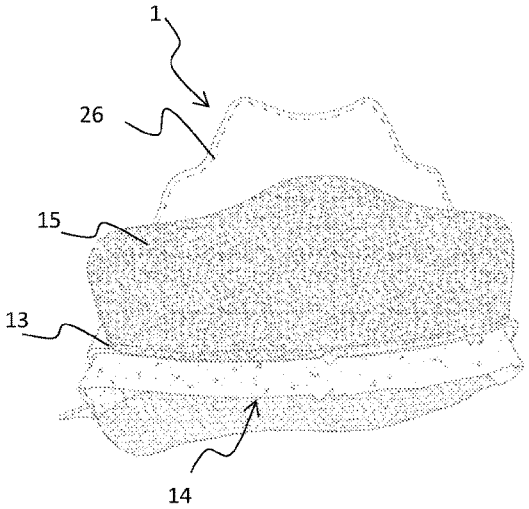
FIGS. 10 and 11 refer to the application of a buttress and an upper padding.
Figure 11:
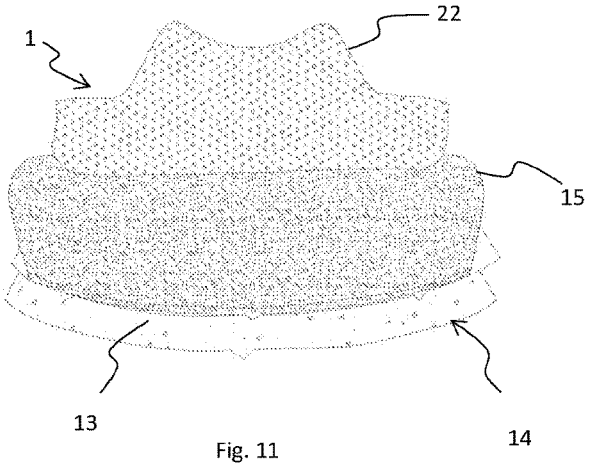
Figure 12:
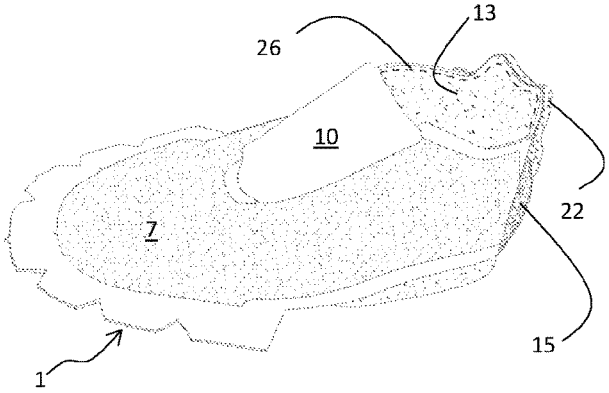
FIG. 12 shows the upper before being turned over.

Advantageously, a buttress 15 and a padding 22 are applied to the upper 1, for example, by underneath sewing between the buttress 15 and the upper 1 and then by gluing the padding 22 to the buttress, as indicated in FIGS. 10 and 11. The buttress 15 and the padding 22 are intended to be placed in a rear position of the final footwear, as shown in FIG. 12.

Figure 14:
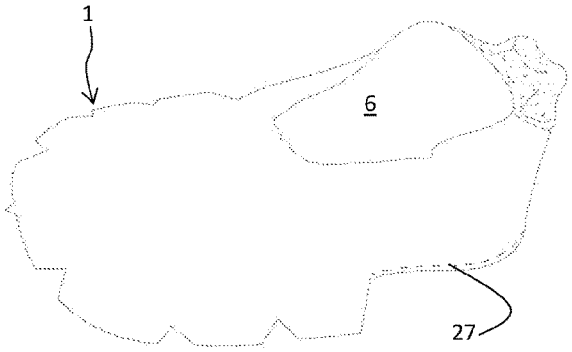
FIG. 14 shows the tongue as fixed to the upper.

Subsequently, the upper 1 is turned over so that it assumes the configuration shown in FIG. 14.

In this configuration it is advantageously possible to complete the sewing of the rear lining 13, on the lower flaps, to the upper 1 (lower sewing 27).

Figure 2:
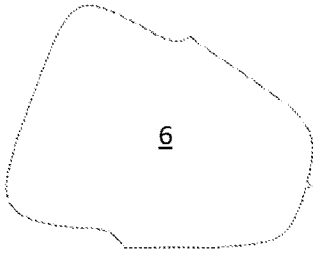
FIG. 2 shows an example of a tongue for footwear.

Subsequently, it is possible to proceed with the steps of applying the tongue 6 (shown in FIG. 2) to the upper 1 so that it extends above the under-tongue element 10, which is already applied to the upper 1, covering the seams thereof.

The tongue 6 has already been subjected to the thickness reduction operation, as described above. Advantageously, the tongue 6 is fixed to the upper 1 with a thermo-sealing procedure similar to that used for fixing the two flaps 3 and 4 of the upper 1.

Figure 13:
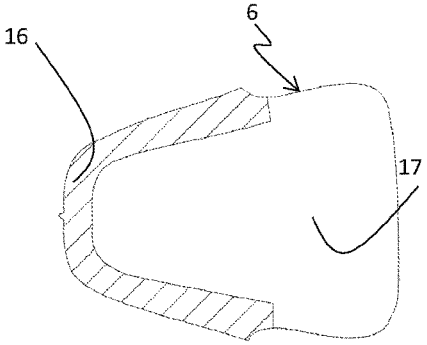
FIG. 13 shows a further thermo-double-sided adhesive tape applied to the tongue.

In greater detail, the area of application of the tongue 6, defined by the marks 5 is cleaned, and then the application is made of a further thermo-double-sided tape 16 (FIG. 13) on an internal face of the tongue 6 on a first fixed edge of the tongue in correspondence with a first portion of the flap, leaving instead a second portion 17 free of adhesive, resulting in a second free edge of the tongue unaffixed with respect to the upper. The application of the further thermo-adhesive tape 16 to the inner face of the tongue 6 may be performed using process parameters similar to the thermo-adhesive parameters described with reference to the application of the thermo-adhesive tape 8 to the first flap 3. The tongue 6 is then arranged (FIG. 14) so that the exposed face of the further thermo-adhesive tape 16 adheres to the upper 1 and so the tongue 6 covers the under-tongue element 10.

Figure 15:
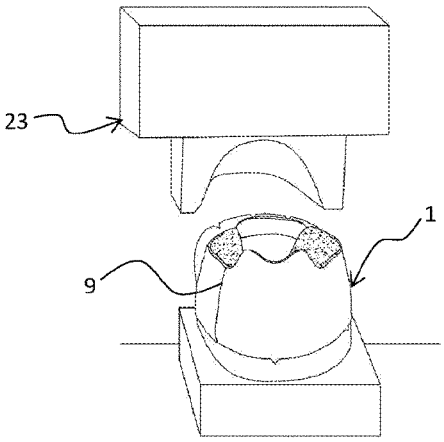
FIGS. 15 and 16 refer to steps of form-shaping and cambering of the upper.

The adhesion of the tongue 6 is favored by a thermo-welding operation that includes a thermal stabilization (raising the temperature) and a pressing carried out by means of a shaper 23 that also allows to give the desired shape to the upper 1 (FIG. 15), making it assume a three-dimensional concave shape suitable for overlapping a foot. Such heat-sealing can advantageously be done using the same process parameters described in relation to heat-sealing for flaps 3 and 4.

Also in this case, the process parameters indicated are useful for obtaining impermeability. The tongue 6 is intended to result, in the footwear 100 as completed, higher (evaluating this height from the sole of the footwear) than the portion of the upper 1 to which it is attached, which results lower and that is closer to the sole. In order to avoid that the mode of fixing the tongue 6 to the upper 1 may form a substantially horizontal step capable of collecting and retaining dirt, in the application of the tongue 6 to the upper 1 it is advantageously proceeded in such a way that the portion of the upper 1 interested in the fixing results below (i.e., more internal) the tongue 6, which instead surmounts the upper 1, resulting external to the finished footwear, and wherein the second free edge of the tongue 6 is a greater distance from the insole 19 the first fixed edge of the tongue 6 from the insole 19. Thanks to the fact that the tongue 6 overlaps the portion of upper 1 to which it is fixed, it favors the sliding of dirt/impurities, possibly present on the tongue 6 towards the ground, on which the footwear rests.

Figure 16:
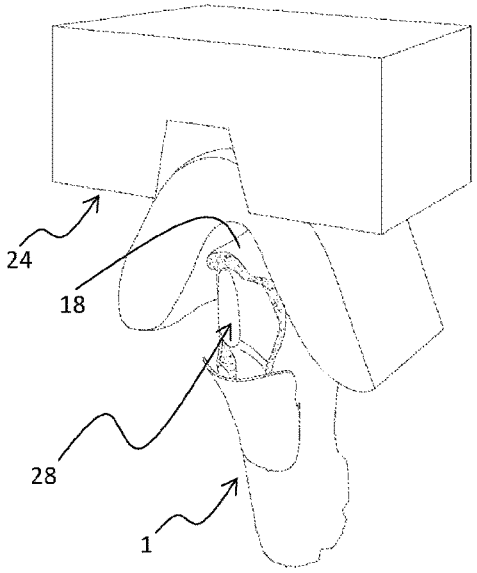

As shown by way of example in FIG. 16, a cambering of the heel 18 of the upper 1 is then carried out. This cambering can be carried out, for example, by means of a cambering machine 24 (which operates, for example, with the following values: 150° C., 15 sec, 0.4 MPa) associated with a form 28. The cambering machine 24 is represented schematically in FIG. 16.

As known, "cambering" (in Italian language also known as "garbatura") is an operation consisting in giving, generally through a special machine, to a piece (particularly the upper) that has been obtained flat from the model, a curvature such as to make it adhere easily to the form and to facilitate the assembly of subsequent components. In this phase, due to the raising of the temperature, the glue present on the buttress 15 is reactivated and with the pressure the buttress 15 adheres to the upper 1.

Figure 17:
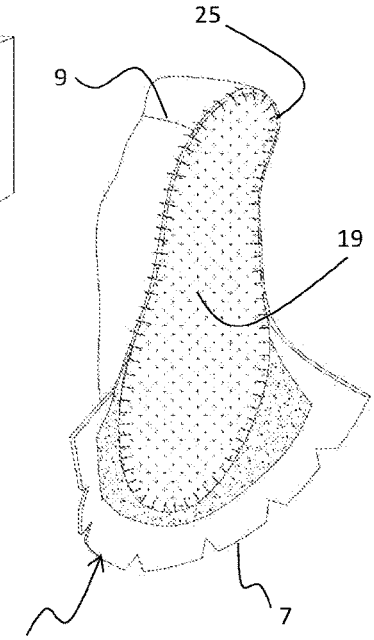
FIG. 17 shows the application of an insole by sewing, for example, by ströbel sewing.

Subsequently, as shown in FIG. 17, an insole 19 is fixed (for example, by a strobel sewing 25) to the lower part of the already shaped upper 1. As an alternative to the ströbel sewing 25, a classic assembly can be carried out using fixing nails or a thermoplastic glue, as is known to those skilled in the art.

This insole 19 can advantageously be of the anti-perforation type.

If the insole 19 is of the anti-perforation type, it can be of the textile type, i.e., it can be made for example with a multilayer fabric in ballistic polyester, but other materials are not excluded. Alternatively, the anti-preformation property can be obtained by using an insole made of a traditional material (for example, a non-woven fabric-TNT; fiber cardboard, or synthetic material) with the interposition, between the insole itself and the sole of the footwear 100, of a metal foil.

Furthermore, according to the example, a band 29 is glued to a toe protection tip 20.

Figure 18:
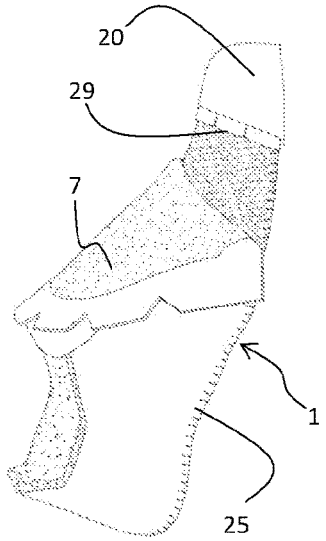
FIG. 18 refers to the process of inserting a toe protection tip and strap into the footwear.

FIG. 18 shows a phase of housing the tip 20 provided with a band 29 on the tip of the upper following the distribution of glue on the internal surface of the tip 20 to glue it to the upper 1. The upper 1 is pulled and closed on the tip 20 and glued under the front part of the insole (this operation is called "pre-mounting"). Then a temperature increase (for example, up to 130° C.) and a subsequent stabilization at low temperature, are carried out.

By using, for example, a grinding wheel, it is also possible to remove the excess parts of the upper 1.

The sole 21 is then constructed (FIG. 19), for example, by direct injection molding on the upper. The sole 21 is made, for example, by injecting liquid polyurethane into a closed mold on the upper 1. This technique also allows the insole 19 to be sealed, which is essential for the purposes of waterproofing the finished footwear 100.

Figure 19:
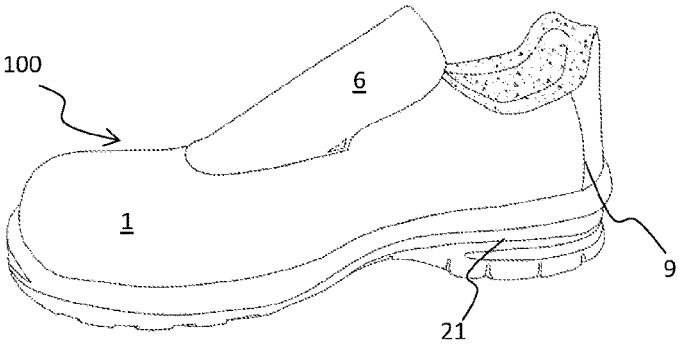
FIG. 19 shows the completed footwear, in a side view, equipped with a sole.
Figure 20:
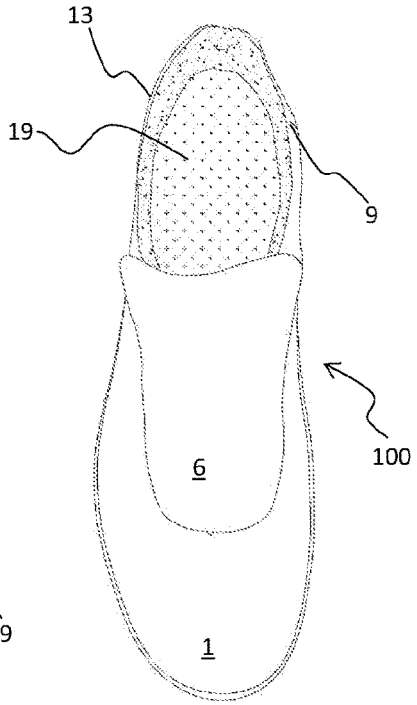
FIG. 20 shows a top view of said footwear.

The footwear 100 is then completed, as shown in the views of FIGS. 19 and 20.

The footwear 100 in its entirety can be made, using the method described above, in such a way as to be waterproof. In particular, considering the requirement shown in EN ISO standard "paragraph 6.2.5, EN ISO 20345:2011", the footwear 100 can be such that after a dynamical flexion test in water for 4800 cycles lasting 80 min, carried out according to the test method described in EN ISO 20344 standard: 2011 ref. 5.15, has an internal humid area of less than 3 $cm^2$.

The footwear 100 and the manufacturing method described have numerous advantages.

An advantage is due to the fact that the fixing of the flaps 3 and 4 of the upper 1 and the fixing of the tongue 6 to the upper 1 are carried out without seams but by thermo-sealing. According to traditional techniques, the seams made for the purpose of joining have a component of the upper that surmounts the other one and the step that is formed (greater than 1 mm) is a source of accumulation of impurities (dirt) and stagnation of liquids which could therefore more easily infiltrate. The technique described above avoids the formation of such a thick step and consequently the accumulation of dirt and stagnation of liquids. The feature whereby the tongue 6 overlaps the portion of the upper 1 to which it is attached helps to prevent step formation, as discussed above.

Furthermore, it should be noted that often in the workplace there is a strong presence of liquids and there are climatic conditions with high temperatures (such as, for example, the kitchens). The absence of seams between portions of the upper 1 and with the tongue 6 of the footwear 100 reduces the risk of penetration of liquids from the cracks caused in traditional footwear by the passage of the needle. It should also be noted that the construction technique of the present solution avoids the use of waterproof membranes to be provided inside the upper, as instead occurs in some types of footwear of the known art. These membranes are not very breathable, therefore they are highly not recommended in work environments with high temperatures (kitchen).

In addition, it should be noted that the sole-making technique which uses liquid polyurethane is particularly advantageous and allows at the same time to seal the insole 19 and to make the sole 21 by direct injection onto the upper, without the need to glue and/or sew it subsequently.

LIST OF NUMBERS IN THE DRAWINGS footwear 100
upper 1
main portion 2
first extreme flap 3
second extreme flap 4
marks 5
tongue 6
reinforcement fabric 7
thermo-double-sided tape 8
junction zone 9
under-tongue element 10
internal opening 11
front lining 12
back lining 13
full lining 14
buttress 15
further thermo-double-sided tape 16
second portion 17
heel 18
insole 19
tip 20
sole 21
padding 22
shaper 23
cambering machine 24
ströbel sewing 25
upper seam 26
under seam 27
cast 28
band 29

The invention claimed is:

1. A water-resistant footwear comprising:

an upper formed of a material that is water vapor transpiring and water resistant, said upper having a first flap and a second flap and at least one portion having a thickness, each of the first flap and the second flap having a respective thickness less than the thickness of the at least one portion;

a thermo-double-sided adhesive layer interposed between the first flap and the second flap, wherein said thermo-double-sided adhesive layer is activatable by an increase in temperature applied thereto, wherein the first flap and the second flap are heat-sealed to each other by said thermo-double-sided adhesive layer;

a lining fixed to said upper so as to directly face an internal face of said upper;

an insole affixed to an edge of said upper;

a waterproof sole directly injection molded onto said upper so as to cover one face of said insole in sealing relation thereto;

an under-tongue element fixed by a seam to a first portion of the internal face of said upper; and a tongue having a fixed edge affixed and heat sealed to a second portion of an outer face of said upper by another thermo-double-sided adhesive layer, the another thermo-double-sided adhesive layer being activatable by a temperature increase applied thereto, wherein said tongue has a free edge unfixed with respect to said upper, the free edge being a greater distance from said insole than a distance of the fixed edge of said tongue from said insole, said tongue extending so as to overlap said under-tongue element and to cover the seam, wherein the fixed edge surmounts the second portion of the outer face of said upper.

2. The water-resistant footwear of claim 1, wherein said insole is formed of a multilayer ballistic polyester fiber.

3. The water-resistant footwear of claim 1, wherein said insole has a metal sheet thereon or therein.

4. The water-resistant footwear of claim 1, wherein said under-tongue element is a polymeric material or an elastomeric mesh material, wherein said material of the upper and a material of said tongue are one of a microfiber, a leather, and a synthetic material.

5. The water-resistant footwear of claim 1, further comprising: a reinforcement fabric at least partially covering the internal face of said upper, said reinforcement fabric being of a jersey material.

6. The water-resistant footwear of claim 1, further comprising: a reinforcement fabric at least partially covering the internal face of said upper, said reinforcement fabric being of a polyester material.

7. The water-resistant footwear of claim 1, wherein said lining is of a polyester material.

8. The water-resistant footwear of claim 1, wherein said lining is of a polyamide material.

9. The water-resistant footwear of claim 1, wherein said lining is of a recycled polyester material.

10. The water-resistant footwear of claim 1, further comprising:

a reinforcement fabric affixed to the internal face of said upper.

11. The water-resistant footwear of claim 10, wherein said lining faces said reinforcement fabric.

* * * * *